United States Patent [19]

Moberg

[11] 4,278,281

[45] Jul. 14, 1981

[54] SEAL

[75] Inventor: Sigurd M. Moberg, Etlan, Va.

[73] Assignee: E. J. Brooks Company, Newark, N.J.

[21] Appl. No.: 8,417

[22] Filed: Feb. 1, 1979

Related U.S. Application Data

[63] Continuation-in-part of Ser. No. 847,551, Nov. 1, 1977, abandoned.

[51] Int. Cl.[3] ..... B65D 33/34

[52] U.S. Cl. ..... 292/320

[58] Field of Search ..... 292/307-326

[56] References Cited

U.S. PATENT DOCUMENTS

| | | | |
|---|---|---|---|
| 513,908 | 1/1894 | Flower et al. | 292/320 |
| 521,427 | 6/1894 | Torsch | 292/320 |
| 989,438 | 4/1911 | Stanford | 292/320 |
| 1,943,988 | 1/1934 | Peake | 292/318 |
| 1,964,897 | 7/1934 | Wenk | 292/320 |
| 3,146,012 | 8/1964 | King, Sr. | 292/320 |
| 3,375,033 | 3/1968 | Moberg | 292/320 |

*Primary Examiner*—Richard E. Moore

[57] ABSTRACT

A seal of the type resembling a padlock and comprising a plastic housing having two portions joined only by a weakened portion, each of the housing portions having an aperture for receiving an end of a shackle. In the illustrated and preferred embodiment the weakened portion is disposed at the bottom of a narrow elongated recess formed by adjacent housing portions, to minimize the effect of exposure to sunlight on the weakened portion. The seal can be easily fractured along the weakened portion, unintentionally, by unauthorized persons trying to remove the seal without destroying it, and can be easily fractured intentionally by authorized service personnel to facilitate removal. In an embodiment of the invention in which the shackle is a wire having reverse bent end portions, which end portions are each maintained in a flexed condition, when assembled into the housing opening, and in which the two housing portions are connected only by a centrally disposed thin web, attempts to remove an end portion will cause the extreme end of the reverse bent portion to pierce through the wall of the housing and start a fracture in the thin connecting web, which provides evidence of tampering, and often causes the web to break, allowing the housing portions to separate, giving obvious evidence of tampering.

5 Claims, 6 Drawing Figures

SEAL

CROSS-REFERENCE

This application is a continuation-in-part of my application Ser. No. 847,551 filed Nov. 1, 1977, now abandoned.

BACKGROUND OF THE INVENTION

In my U.S. Pat. No. 3,485,521 there is illustrated a seal of the padlock type, in which the body is formed of a synthetic organic plastic with a pair of apertures opening to one end of the body, and the shackle is formed of a U-shaped piece of wire having reverse bent end portions, which end portions, when inserted into the body openings, are locked therein by the end portion being maintained in a flexed condition so that the end of the reverse bent portion digs into the wall of the housing aperture.

Although the seal as illustrated in the above-identified patent has achieved considerable commercial success, it has been found that in some instances it has been possible to work an end of the shackle out of its aperture to enable the seal to be removed and re-assembled without leaving evidence of tampering.

It has been proposed that if the end portions of the shackle were bent outwardly, rather than inwardly, as illustrated in said patent, such attempts to remove a shackle end would cause the extreme end to pierce the outside wall of the housing. However, in such case, the protruding reversely bent end can be cut off, and the remainder of the leg pulled out of the housing. When, after the protected closure has been opened, the seal can be re-assembled by forming a new reverse-bent end portion on the end of the leg that has been cut off.

Such seals must often be removed by authorized service personnel, which can be done only by cutting the spring steel shackle with a special type of wire cutter. Such tools are expensive and often lost by the service personnel.

SUMMARY OF THE INVENTION

A seal of the padlock type is provided with a plastic body having a pair of spaced apertures to receive shackle ends, the body having a weakened portion formed between the apertures. In one embodiment the weakened portion may be formed by a narrow slot formed in one or both faces of the body, forming body portions connected by a thin web. The shackle also is provided with a centrally located weakened portion.

Attempts to remove a shackle leg by an unauthorized person which requires that the body be manually held with considerable strength, will break the web, which breakage may be facilitated by the fact that sufficient pulling force on the leg will cause the end thereof to pierce the wall of the body and start a fracture in the web. Further flexing of the web resulting from squeezing of the body will allow the body portions to separate, giving conclusive evidence of tampering.

However, the seal may be easily removed without the use of special tools by intentionally breaking the body so that the two portions separate, and thereafter bending or twisting the shackle so that it breaks at the centrally located weakened portion.

Since in most installations, the seal is used in outdoor locations, in a preferred embodiment of the invention, the slot is deeper than it is wide, to minimize the effect of sunlight on the thin web at the bottom of the slot.

DESCRIPTION OF THE ILLUSTRATED EMBODIMENT

Figure 1:
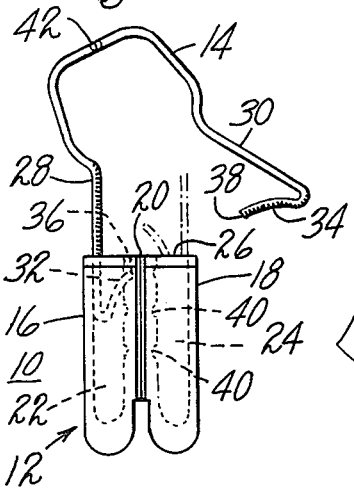
FIG. 1 is a plan view of a seal embodying the features of the invention with the shackle in the open position.

Referring to the drawing, there is illustrated a seal 10, which comprises a housing or body 12 formed of synthetic organic plastic such as polypropylene, and a shackle 14 formed of spring wire.

The illustrated embodiment of the housing 12 comprises a pair of spaced body portions 16 and 18 joined by a thin web 20 forming a slot 21 in both faces of the body. The portions 16 and 18 have apertures 22 and 24 respectively formed therein and opening only to the top 26 of the housing.

The shackle 14 is generally U-shaped to provide a pair of legs 28 and 30, the ends of which have reversely bent end portions 32 and 34. As described in the above-identified patent, the length and angle of the end portions 32 and 34 is such in relation to the size of the apertures that when a shackle end is inserted into a body aperture, the bent end is maintained in a flexed condition in the aperture so that the extreme end (36 or 38) of the end portion digs into the aperture wall to prevent removal of the shackle without leaving visible evidence of tampering. Notches 40 may be provided in the aperture wall to assist in allowing the ends 36 and 38 to dig into engagement with the wall.

The medial portion of the shackle 14 is provided with a weakened portion 42, for a purpose to appear hereinafter.

The seal 10 is normally supplied to the user with the longer leg 28 retained in one body aperture and the reverse bend of the shorter leg 30 projecting into the other aperture, but with the extreme end 38 thereof not entered into the aperture, so that said leg 30 may be readily released from the aperture for assembly with a closure fastener on an electric meter or the like.

Figure 2:
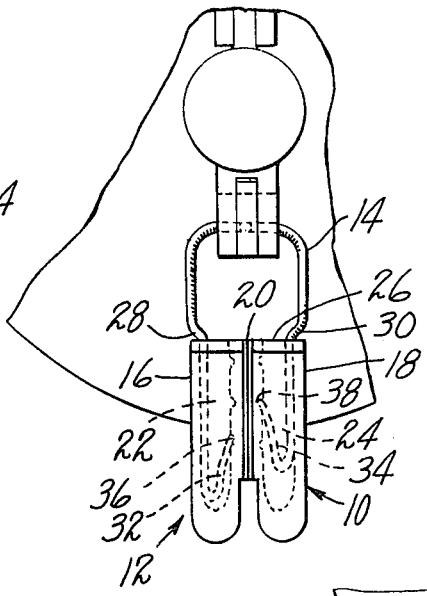
FIG. 2 is a plan view of the seal of FIG. 1 assembled with a closure fastener of a device to be protected.
Figure 3:
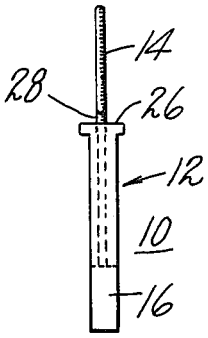
FIG. 3 is a view of the seal of FIG. 2 as seen from the left side.
Figure 4:
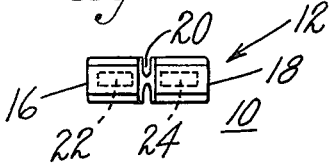
FIG. 4 is a view of the seal of FIG. 2 as seen from the bottom.
Figure 5:
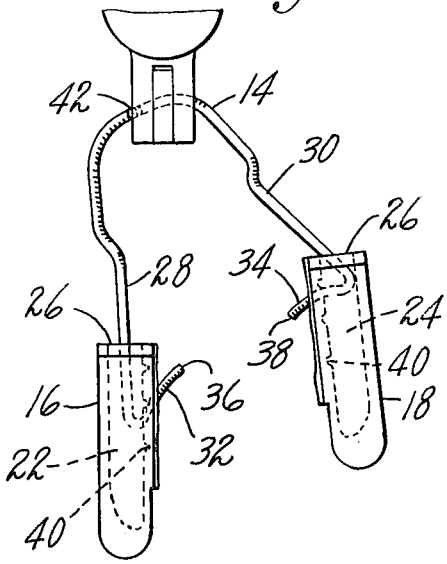
FIG. 5 is a plan view of the seal assembly of FIG. 2 in which the seal has been broken by attempts to remove the wire shackle ends from the plastic body.

Such assembly is accomplished by inserting the free leg 30 of the shackle through the closure fastener opening, and then inserting the leg 30 into said other body aperture, and forcing the shackle legs down into the apertures, to the position shown in FIG. 2.

In the illustrated embodiment the web 20 connecting the two body portions is positioned mid-way between the two side faces of the portions for reasons now to be described.

Since the seal is often used on outdoor electric meter installations, it is desirable to minimize the effect of solar ultra-violet radiation on the thin web 20. For this reason it is desirable that the slot have a greater depth than width, so that if the seal is hanging so that a side of the body is facing south, the web will receive direct solar radiation for only a short time.

Although the web could be positioned on one face of the body, so that the slot would open only to the other face, the seal could then be inadvertently installed so that the side of the seal having the web would be exposed, so that the web would receive continuous radiation. Although such a structure would be suitable for interior installations, the illustrated structure is preferred for exterior installations.

In either structure, it is preferred that the apertures 22 and 24 be so positioned in relation to the web that the extreme ends of the shackle are positioned in alignment with the web, for the following reason.

The usual method used by an unauthorized person to remove a shackle leg from the housing of a seal of the type shown in the above-identified patent is by grasping the housing with one hand and, with a pair of thin-nosed pliers grasping the leg at the top surface of the housing. With manipulation of the pliers, it has been possible to sometimes work the shackle end out of the housing, or to cause the shackle end to pierce the housing so it can be cut off.

However, when the illustrated seal is manually grasped firmly enough to resist the necessary pulling force on a shackle leg, the seal body flexes at the connecting web 20. As the wire is flexed back and forth by the grasping instrument, flexing of the web also occurs. It has been found that the pressure that must be applied to the body by one hand to resist the pulling force that is applied to the shackle almost inevitably causes the body to break in half at the web 20. In some cases the pulling force on the shackle causes an end of a shackle leg to pierce the body wall and the adjacent portion of the web, facilitating the breaking of the web.

After the body is broken, the seal may or may not then be removed by the person attempting to open the device protected by the seal, but in either case the broken or missing seal gives clear evidence of tampering.

Figure 6:
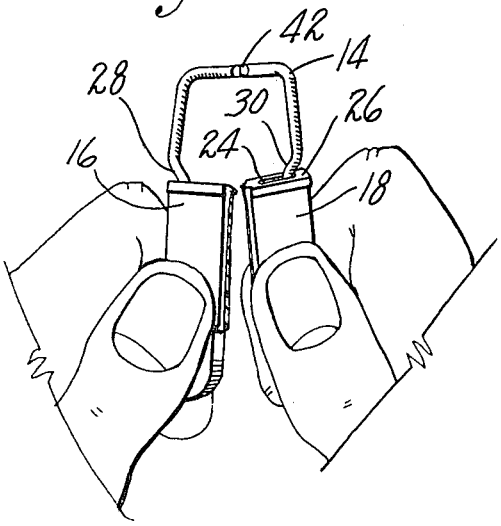
FIG. 6 is a perspective view of the seal assembly of FIG. 2 in which the seal has been intentionally broken, illustrating the method of breaking the shackle to enable the seal to be removed from the closure fastener.

The seal may be easily removed by authorized personnel by breaking the seal body and then separating the two body portions with a twisting motion (see FIG. 6) so that the shackle breaks at the weakened portion 42. The two portions may then be removed from the closure fastener and discarded. After the adjustment or repair to the device is completed, a new seal is applied.

Although in the illustrated embodiment of the invention, the shackle is formed of spring steel, it will be understood that in some applications a plastic shackle may be used. In such case the shackle may have locking ridges and each aperture locking fingers as shown in my U.S. Pat. No. 3,467,427 issued Sept. 16, 1969, and the body apertures may be closed at the bottom, as illustrated, or may be open, as illustrated in said U.S. Pat. No. 3,467,427, so that the shackle ends may be pulled through the body for tightening.

Since certain other changes apparent to one skilled in the art may be made in the illustrated and described embodiments of the invention without departing from the scope thereof, it is intended that all matter contained herein be interpreted in an illustrative and not a limiting sense.

I claim:

1. A seal of the padlock type, comprising a shackle and a body having two portions, each portion having an aperture for receiving a shackle end, said shackle and said apertures being provided with cooperating means for locking the shackle ends in the apertures, said body portions being joined only by a thin flexible web portion disposed between the apertures which is easily breakable manually, and said shackle having a medially disposed weakened portion whereby the seal may be readily released from a closure fastener with which it is installed by being separable along the easily breakable portion of the body and at the weakened portion of the shackle into two portions, each comprising a body portion and a shackle portion.

2. A body for a seal of the padlock type, said body being formed of a material which is easily broken manually in thin sections and is piercable by the end of a stiff wire, and comprising two portions joined to each other along adjacent sides by a thin web, each portion having an aperture opening to an end of the portion, each of said apertures lying alongside and being closely adjacent to the side of the body portion having the thin web so as to form a wall on said adjacent sides of the body which is sufficiently thin as to be readily pierced by the end of a reversely bent shackle wire disposed in said opening on attempts to pull the wire out of the opening.

3. A seal of the padlock type, comprising a shackle and a body having two portions, each having an aperture for receiving a shackle end, said shackle and said aperture having cooperating means for locking the shackle ends in the apertures, said body portions being joined by a thin web which is easily breakable manually, said web and said body portions being so positioned and dimensioned that the web and the adjacent body portions form slots on each side of the web, each slot having a depth greater than its width at the surface of the body with the web being disposed at the bottom of the slot.

4. A seal of the padlock type, comprising a shackle and a body having a pair of spaced apertures for receiving the opposite shackle ends said shackle and said apertures having cooperating means for locking the shackle ends in the apertures, said body having a slot formed in substantially the entire length thereof between the apertures on opposite sides of the body, whereby the body may be broken into two portions at the slot with each portion containing an aperture, each slot having a depth greater than its width at the surface of the body and forming a thin web at the bottom of the slot.

5. A seal as set out in claim 4 in which the shackle has a weakened portion between the ends, whereby the entire seal may be broken into two portions to allow removal of the shackle from a device with which it is assembled.

* * * * *